US009133671B2

(12) United States Patent
Kellner

(10) Patent No.: US 9,133,671 B2
(45) Date of Patent: Sep. 15, 2015

(54) WIRELINE SUPPORTED BI-DIRECTIONAL SHIFTING TOOL WITH PUMPDOWN FEATURE

(75) Inventor: Justin C. Kellner, Pearland, TX (US)

(73) Assignee: Baker Hughes Incorporated, Houston, TX (US)

( * ) Notice: Subject to any disclaimer, the term of this patent is extended or adjusted under 35 U.S.C. 154(b) by 347 days.

(21) Appl. No.: 13/295,994

(22) Filed: Nov. 14, 2011

(65) Prior Publication Data

US 2013/0118762 A1 May 16, 2013

(51) Int. Cl.
*E21B 23/08* (2006.01)
*E21B 23/00* (2006.01)
*E21B 34/14* (2006.01)

(52) U.S. Cl.
CPC ..... *E21B 23/00* (2013.01); *E21B 23/08* (2013.01); *E21B 34/14* (2013.01)

(58) Field of Classification Search
CPC ..... E21B 23/03; E21B 23/06; E21B 23/08
USPC ..... 166/381, 383, 385, 386, 387
See application file for complete search history.

(56) References Cited

U.S. PATENT DOCUMENTS 2,949,963 A 8/1960 Mcgowan et al.
3,468,258 A 9/1969 Arutunoff
3,552,718 A 1/1971 Schwegman
3,981,364 A 9/1976 Warner et al.
4,083,401 A 4/1978 Rankin
4,124,070 A 11/1978 King et al.
4,392,377 A 7/1983 Rankin
4,493,376 A 1/1985 Magee, Jr.
4,494,608 A 1/1985 Williams et al.
4,671,359 A 6/1987 Renfro
4,924,940 A 5/1990 Burroughs et al.
5,025,861 A 6/1991 Huber et al.
5,050,682 A 9/1991 Huber et al.
5,095,993 A 3/1992 Huber et al.
5,183,114 A 2/1993 Mashaw, Jr. et al.
5,211,241 A 5/1993 Mashaw, Jr. et al.
5,305,833 A 4/1994 Collins
5,309,988 A 5/1994 Shy et al.
5,318,128 A 6/1994 Johnson et al.
5,327,974 A 7/1994 Donovan et al.
5,355,953 A 10/1994 Shy et al.

(Continued)

OTHER PUBLICATIONS

Schwanitz, B., "Isolation Valve Contingencies Using Wireline Stroker and Tractor Technologies", SPE 124616, Oct. 2009, 1-6.

(Continued)

*Primary Examiner* — Brad Harcourt
(74) *Attorney, Agent, or Firm* — Steve Rosenblatt

(57) ABSTRACT

A shifting tool for sleeves is supported on wireline or slickline and is pumped to the desired location by pressure from above delivered against the tool and passing around its periphery or against an articulated peripheral extending member that can optionally seal. Once in the vicinity of the desired sleeve to be shifted the shifting key is engaged to the sleeve and further applied pressure on the articulated peripheral seal shifts the sleeve in a downhole direction. The sleeve can also be shifted in an uphole direction with an anchor that grabs near the sleeve and a latch key that grabs the sleeve and is configured to retain grip as a motor moves the latch key uphole. Power can come from a wireline or can be locally provided if using slickline. The seal or extending member is retractable for tool removal or relocation.

10 Claims, 2 Drawing Sheets

(56) References Cited

U.S. PATENT DOCUMENTS

| | | | | |
|---|---|---|---|---|
| 5,375,658 | A | 12/1994 | Schultz et al. | |
| 5,392,856 | A | 2/1995 | Broussard, Jr. et al. | |
| 5,641,023 | A | 6/1997 | Ross et al. | |
| 5,819,848 | A | 10/1998 | Rasmuson et al. | |
| 6,026,911 | A | 2/2000 | Angle et al. | |
| 6,041,857 | A | 3/2000 | Carmody et al. | |
| 6,059,030 | A | 5/2000 | Celestine | |
| 6,138,764 | A * | 10/2000 | Scarsdale et al. | 166/382 |
| 6,189,617 | B1 | 2/2001 | Sorhus et al. | |
| 6,189,621 | B1 | 2/2001 | Vail, III | |
| 6,196,319 | B1 | 3/2001 | Henskens et al. | |
| 6,343,649 | B1 | 2/2002 | Beck et al. | |
| 6,359,569 | B2 | 3/2002 | Beck et al. | |
| 6,397,946 | B1 | 6/2002 | Vail, III | |
| 6,405,798 | B1 | 6/2002 | Barrett et al. | |
| 6,464,012 | B1 | 10/2002 | Strickland | |
| 6,481,505 | B2 | 11/2002 | Beck et al. | |
| 6,497,280 | B2 | 12/2002 | Beck et al. | |
| 6,543,538 | B2 | 4/2003 | Tolman et al. | |
| 6,588,505 | B2 | 7/2003 | Beck et al. | |
| 6,607,607 | B2 | 8/2003 | Walker et al. | |
| 6,945,330 | B2 | 9/2005 | Wilson et al. | |
| 6,983,795 | B2 | 1/2006 | Zuklic et al. | |
| 7,051,810 | B2 | 5/2006 | Clemens et al. | |
| 7,080,701 | B2 | 7/2006 | Bloom et al. | |
| 7,111,677 | B2 | 9/2006 | St. Clair | |
| 7,121,343 | B2 | 10/2006 | Telfer | |
| 7,150,318 | B2 | 12/2006 | Freeman | |
| 7,152,680 | B2 | 12/2006 | Wilson et al. | |
| 7,325,606 | B1 | 2/2008 | Vail, III et al. | |
| 7,367,397 | B2 | 5/2008 | Clemens et al. | |
| 7,387,165 | B2 | 6/2008 | Lopez de Cardenas et al. | |
| 7,392,859 | B2 | 7/2008 | Mock et al. | |
| 7,467,661 | B2 | 12/2008 | Gordon et al. | |
| 7,556,102 | B2 | 7/2009 | Gomez | |
| 7,617,875 | B2 | 11/2009 | Darnell et al. | |
| 7,878,242 | B2 | 2/2011 | Gray | |
| 2001/0013410 | A1 | 8/2001 | Beck et al. | |
| 2001/0013411 | A1 | 8/2001 | Beck et al. | |
| 2001/0042617 | A1 | 11/2001 | Beck et al. | |
| 2001/0043146 | A1 | 11/2001 | Beck et al. | |
| 2004/0045709 | A1 | 3/2004 | Zuklic et al. | |
| 2004/0112587 | A1 | 6/2004 | Van Drentham Susman et al. | |
| 2005/0034874 | A1 | 2/2005 | Guerrero et al. | |
| 2005/0072577 | A1 * | 4/2005 | Freeman | 166/386 |
| 2005/0126791 | A1 | 6/2005 | Barbee et al. | |
| 2005/0217861 | A1 | 10/2005 | Misselbrook | |
| 2006/0090900 | A1 | 5/2006 | Mullen et al. | |
| 2006/0108117 | A1 | 5/2006 | Telfer | |
| 2006/0124310 | A1 | 6/2006 | Lopez de Cardenas et al. | |
| 2006/0201716 | A1 | 9/2006 | Bloom et al. | |
| 2007/0151732 | A1 | 7/2007 | Clemens et al. | |
| 2007/0251687 | A1 | 11/2007 | Martinez et al. | |
| 2007/0272411 | A1 | 11/2007 | Lopez de Cardenas et al. | |
| 2008/0029276 | A1 | 2/2008 | Templeton et al. | |
| 2008/0251254 | A1 | 10/2008 | Lynde et al. | |
| 2009/0045975 | A1 | 2/2009 | Evans et al. | |
| 2009/0294124 | A1 | 12/2009 | Patel | |
| 2009/0301723 | A1 | 12/2009 | Gray | |
| 2010/0108323 | A1 | 5/2010 | Wilkin | |
| 2010/0258289 | A1 | 10/2010 | Lynde et al. | |
| 2010/0258293 | A1 | 10/2010 | Lynde et al. | |
| 2010/0258296 | A1 | 10/2010 | Lynde et al. | |
| 2010/0258297 | A1 | 10/2010 | Lynde | |
| 2010/0258298 | A1 | 10/2010 | Lynde et al. | |
| 2010/0263856 | A1 | 10/2010 | Lynde et al. | |
| 2010/0282475 | A1 * | 11/2010 | Darnell et al. | 166/373 |
| 2010/0288501 | A1 | 11/2010 | Fielder et al. | |
| 2011/0056692 | A1 | 3/2011 | Lopez de Cardenas et al. | |
| 2011/0162835 | A1 | 7/2011 | Gray | |
| 2013/0014939 | A1 * | 1/2013 | Martinez et al. | 166/250.01 |

OTHER PUBLICATIONS

TAM International Brochure; "TAM SlikPak Plus", http://www.tamintl.com/images/stories/pdfs/SlikPakPlus_Brochure.pdf; 4 pages.

Li, J., et al., "Sand Clean out with Coiled Tubing: Choice of Process, Tools, or Fluids?", SPE 113267, Jun. 2008, 1-.

De Jesus, 0., et al., "Real-Time Wire Management System Improved Reliability and Efficiency in Slickline Service Operations", SPE 103168, Sep. 2006, 1-14.

McClatchie, DW., et al., "Coiled Tubing: Extending the Reach of Slickline Operations", SPE 60722, Apr. 2000, 1-6.

Larimore, David R., et al., "Field Cases of Cost Efficient Well Interventions Performed with Advanced Slickline Technology", SPE 38097, Apr. 1997,597-61.

Arnold, R. Stephen, "Innovations in Slickline Technology", SPE 59710,1-5.

"radio-frequency", http://searchnetworking.techtarget.com/definition/radio-frequency, Jul. 2000, 2 pages.

Aker Solutions, Aker Well Service Tractor Technology, 2008, 1-32.

* cited by examiner

WIRELINE SUPPORTED BI-DIRECTIONAL SHIFTING TOOL WITH PUMPDOWN FEATURE

FIELD OF THE INVENTION

The field of this invention is wireline run tools that can be delivered with pumped fluid for actuation of a subterranean tool and more particularly a series of sliding sleeves movable in opposed directions such as in a fracturing operation.

BACKGROUND OF THE INVENTION

Fracturing systems typically involve a series of sliding sleeve valves that are sequentially operated for fracturing a producing formation. These valves can be operated from the bottom up using ball seats on each sleeve where the balls get progressively bigger to land on a designated ball seat while passing through other seats that are bigger still. However, in installation that use many sleeves there is only a finite number of ball sizes that can be used for a given size of the completion string. There is also the matter of keeping track of what size ball has been dropped so that the order is not lost. This technique shifts sleeves in a single direction to open them relying on subsequent balls to isolate sleeves already open from a new sleeve being opened for fracturing a new location.

Wireline or slickline have been used to engage mechanical shifting tools to sleeves with shift keys that can then shift a sleeve between an open and closed position and another position in between for the purpose of pressure equalization, as illustrated in U.S. Pat. No. 5,305,833 and US Publication 2010/0282475.

Another technique is to run a motor with a ball screw drive that is connected to a sleeve so that power supplied to the motor from a wireline moves the sleeve in opposed directions as requires. This design is illustrated in U.S. Pat. No. 6,041,857. Shifting tools have been delivered to a desired location by alternative techniques of lowering on a wireline or using a pumpdown technique as described in U.S. Pat. No. 3,552,718. Another reference to the use of a pumpdown technique for injector valves is U.S. Pat. No. 4,494,608.

In some cases the desire to avoid wireline delivery and its limitations such as inability to advance in horizontal runs, inability to push and limited ability to pull tension has resulted in providing pressure responsive actuators with the sliding sleeves that are sensitive to application and removal of tubing pressure as shown in U.S. Pat. No. 7,617,875.

Other attempts to overcome the delivery shortcomings of wireline have involved using a rigid rod to deliver a shifting tool to shift a sleeve in opposed directions as shown in USP Publication 20100108323. Another approach has been to add a tractor system to a wireline run tool and located tractors at opposed ends for driving the tool in opposed direction such as shown in FIG. 16 of U.S. Pat. No. 6,543,538. Similar to the latter design is U.S. Pat. No. 7,150,318 FIGS. 5-10 that illustrated a pair of driven tracks at opposite ends of a shifting tool. After the tool latches to a sleeve a pressure control member 64 is allowed to extend and applied pressure is then used to shift the tool that is now latched to the sleeve. On opposite hand control member 222 is used for motion in the reverse direction with the tool latched to the sleeve. A similar concept of using pressure to latch and to shift an already delivered tool is shown in U.S. Pat. No. 7,556,102.

What is needed and provided by the present invention is a way to rapidly deploy a subterranean tool to a desired location using a pumping down technique while it is tethered to a wireline or slickline and then using power either stored onboard if a slickline is used or delivered on a wireline to latch the subterranean tool such as a sliding sleeve. Once latched further applied pressure can shift the sleeve in one direction going further downhole. Shifting in the uphole direction is also envisioned with anchoring to the tubular near the sleeve while latched to the sleeve with another portion of the tool where relative movement takes the latched sleeve uphole toward the anchor set in the tubing wall near and above or below the sliding sleeve. These and other aspects of the present invention will be more readily apparent to those skilled in the art from a review of the detailed description and the associated figures while recognizing that the full scope of the invention is to be determined by the appended claims.

SUMMARY OF THE INVENTION

A shifting tool for sleeves is supported on wireline or slickline and is pumped to the desired location by pressure from above delivered against the tool and passing around its periphery or against an articulated peripheral extending member that can optionally seal. Once in the vicinity of the desired sleeve to be shifted the shifting key is engaged to the sleeve and further applied pressure on the articulated peripheral seal shifts the sleeve in a downhole direction. The sleeve can also be shifted in an uphole direction with an anchor that grabs near the sleeve and a latch key that grabs the sleeve and is configured to retain grip as a motor moves the latch key uphole. Power can come from a wireline or can be locally provided if using slickline. The seal or extending member is retractable for tool removal or relocation.

DETAILED DESCRIPTION OF THE PREFERRED EMBODIMENT

Figure 1:
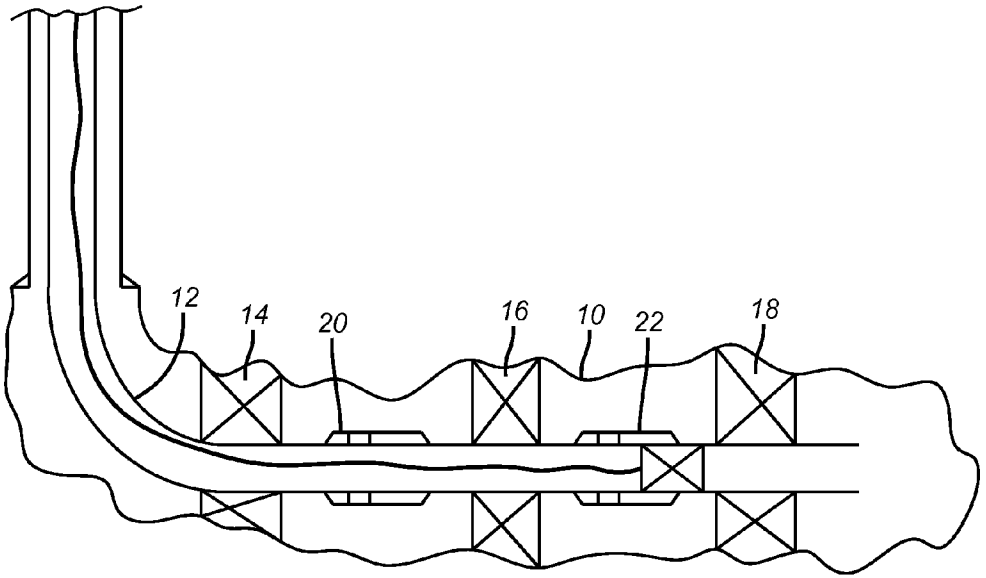
FIG. 1 is a schematic depiction of the shifting tool pumped to the location on a slickline or wireline until engaged to a sleeve to be shifted.

FIG. 1 illustrates an open hole 10 into which a string 12 extends. External packers 14, 16 and 18 straddle respectively sliding sleeves 20 and 22. Although two sliding sleeves are illustrated other quantities are envisioned with internal sliding sleeves being straddled with barriers such as packers on opposed sides while end sliding sleeves can have a packer on one side. For example a lowermost sliding sleeve can have a single packer above and no packer below. In this context above means closer to the surface or the wellhead and below means the opposite.

Figure 2:
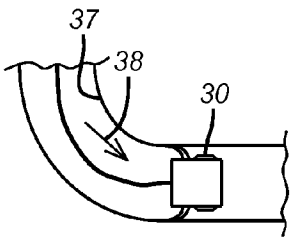
FIG. 2 is an enlarged detail of FIG. 1 showing the articulated seal used to drive the tool to the desired location.
Figure 3:
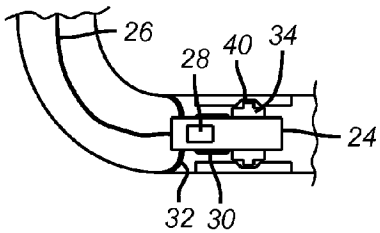
FIG. 3 is a more detailed view showing the grip key as well as the articulated seal of FIG. 2.

The shifting tool 24 is suspended on wireline or slickline 26. If using a slickline there can be an onboard power module 28 for selective operation of sleeve 30 whose movement retracts or allows a peripheral seal such as a cup seal 32 to extend into a sealing position as shown in FIGS. 2 and 3. Alternatively, if a wireline is used the power to operate sleeve 30 or the dogs 34 to engage a profile 36 on the sleeve such as 20 or 22 can come from the surface.

FIG. 2 illustrates the seal 32 that faces uphole in the deployed position with sleeve 30 retracted away from it allowing its shape to make the seal 32 jut out to engage the surrounding tubular wall 37. Pressure applied from uphole indicated by arrow 38 pays out the wireline or slickline 26 as the shifting tool 24 is advanced. Movement of the tool 24 displaces fluid ahead of the tool 24 into the formation defining the open hole 10. The approximate position of the tool 24 can be determined from the amount of line 26 that is paid out or from communication from a casing collar locator that counts collars. In open hole the amount of line 26 paid out is likely the preferred way to approximate the tool 24 location. Depending on the style of the latch key 34 engagement to the profile 40 on the sleeve 20 or 22 can be accomplished by passing the profile 40 then releasing the key 34 to extend and picking up until the profile 40 is engaged. Once that happens pressure represented by arrow 38 is re-established and the application of such pressure to the seal or packer cup 23 then will drive the sleeve 20 or 22 in the downhole direction in which arrow 38 is pointing.

Some variations are envisioned. The tool 24 can be longer and have on it a unique key assembly 34 that can fit the unique profile of each of the sleeves in the tubular 12 so that more than one sleeve such as 20 or 22 can be shifted in a single trip if desired. Seal 23 is preferably a packer cup but can be another type of seal with either internal pliability to be retracted such as when sleeve 30 is advanced over it. However the depiction of sleeve 30 and seal 32 is schematic and those skilled in the art will recognize that a radially articulated seal such as an inflatable can also be used. Some leakage past the seal 32 is tolerable as long as by differential pressure enough force is delivered to the dogs 34 when latched in profile 40 to shift the engaged sliding sleeve. While reference to a seal 32 is made it should be realized that other extending peripheral members around the tool 24 can be used to create the force on the sleeve such as 20 by simply substantially blocking the peripheral space about the tool 24 so that pumped fluid creates a shifting force large enough to move a sleeve such as 20 downhole using applied pressure from the surface despite some leakage flow.

Figure 4:
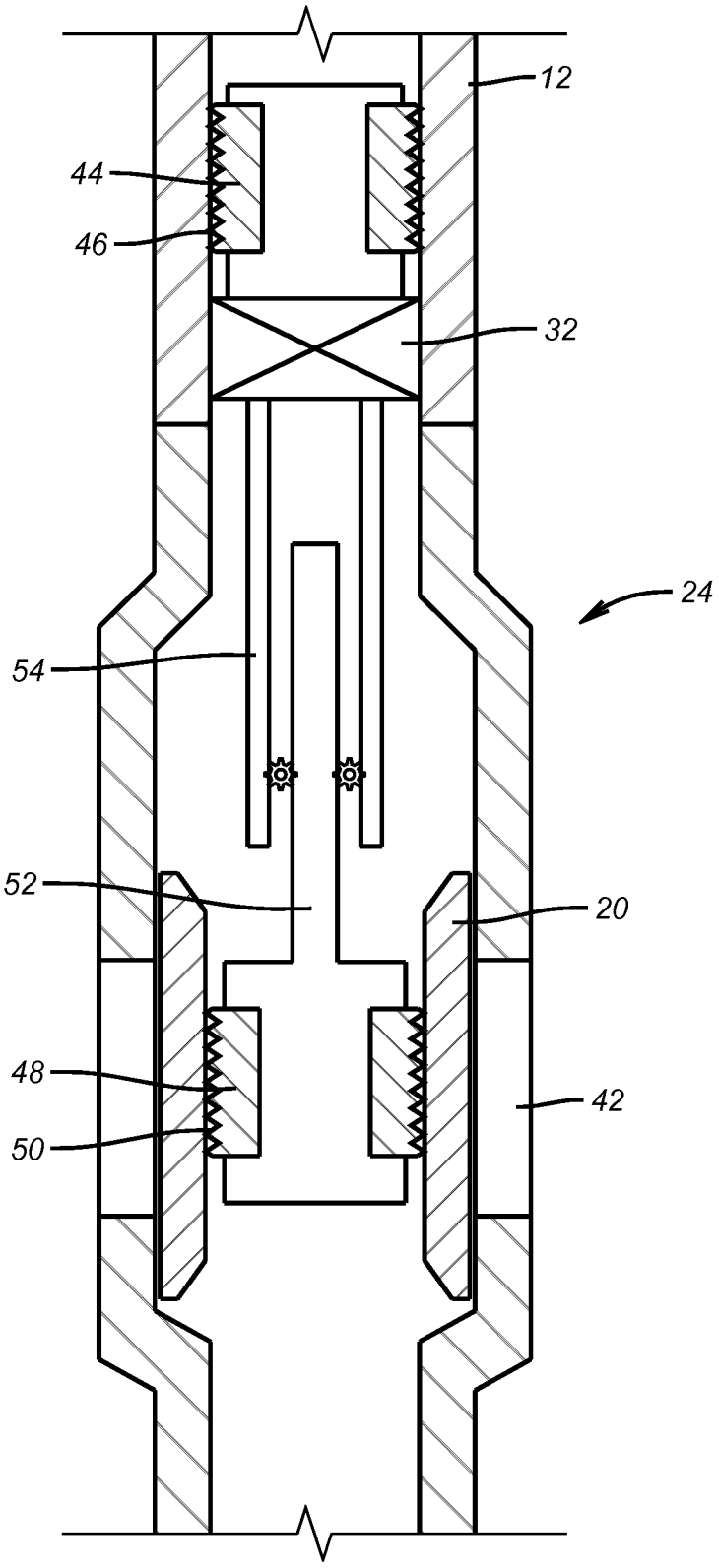
FIG. 4 schematically illustrates a motor drive for the sleeve that is anchored to the tubular for sleeve shifting in either direction.

It should be noted that the tool 24 can only be driven in the downhole direction with pressure 38 from the surface. However, the seal 32 can be retracted using sleeve 30 and the line 26 can be used to reposition the tool 24 in either direction. This is a different operation than trying to shift a sleeve such as 20 in an uphole direction where flow in the direction of arrow 38 will not be effective. One option is to engage a sleeve such as 20 and pull tension on the line 26. However, this is not the optimal solution as the tension stress capacity of the line 26 could be reached before the sleeve such as 20 will budge in the uphole direction. FIG. 4 shows more detail of the tool 24 again in a schematic representation as to how the sleeve 20 can be moved in an uphole direction which is generally the direction for closing a port while movement of the sleeve 20 in the downhole direction is generally to open a port 42. This can be reversed as in FIG. 4 where the port 42 is shown closed. One way to attain this position from when the port 42 is open is to anchor the tool 24 to the tubing 12 with an anchoring assembly 44 that can comprise of a series of extending members with wickers or hard facing 46 to grip the inside wall 37 of the string 12. A second anchoring assembly 48 with external wickers 50 on segments that can be driven out radially is used to grab the sleeve 20. The anchoring assembly 48 is on an actuator rod 52 and is operably connected to a drive system 54 that is schematically illustrated. The drive system 54 can be a motor that turns a ball screw to move the rod 52 in the desired direction. This actuation method can be a backup to using the seal 32 for movement of the sleeve 20 in a downhole direction. The seal 32 does not help when trying to move the sleeve 20 in an uphole direction so that the mechanism of FIG. 4 or other equivalents to it can be used for uphole motion of sleeve 20. As alternatives the system 54 can be a solenoid that when energized moves the rod 52 in the desired direction against a spring return that takes over if the power to the motor is cut off. Electromagnets can be used to create a force to move the rod 52 to shift the sleeve 20. Once the sleeve is shifted to the desired location then the anchoring assembly 48 can release the sleeve 20. When the anchoring assembly 44 is then released the line 26 can then be used to reposition the tool 24.

It should be noted that tractor drives are not used with the designs described above so that the tool is far simple and lighter than the prior designs that combine forward and rear tractor drives with a wireline. The pressure from the surface enables a wireline or slickline supported tool to be rapidly deployed to the desired locations and further enables pressure from above to be the actual driving force for tool operation. Although the preferred embodiment is a sleeve shifting tool 24 other types of tools are envisioned that can be rapidly deployed using an articulated seal or even a leaking peripheral barrier that produces a net force to propel the tool. Some examples are bridge plugs, anchors or fishing tools such as spears or overshots.

The above description is illustrative of the preferred embodiment and many modifications may be made by those skilled in the art without departing from the invention whose scope is to be determined from the literal and equivalent scope of the claims below:

I claim:

1. A method of delivery of a subterranean tool for use at one or more desired subterranean locations, comprising:

supporting the subterranean tool on a wireline or slickline;

inserting the subterranean tool into a borehole from a surface location;

using pressurized fluid in said borehole to drive said subterranean tool to at least one desired location;

engaging a movable component of an existing tool with said subterranean tool at said desired location;

selectively anchoring the subterranean tool at a spaced relation to said movable component so that a portion of said subterranean tool is prevented from axial movement;

using at least one sliding sleeve valve as said existing tool with the movable component;

changing the length of said anchored subterranean tool with respect to a location where said subterranean tool is anchored with pressurized fluid at a further applied pressure to selectively shift said sliding sleeve in opposed directions for positions at opposed ends of travel and therebetween.

2. The method of claim 1, comprising:

operating said subterranean tool with mechanical force.

3. The method of claim 1, comprising:

providing a peripheral articulated member on said subterranean tool;

extending said member;

creating a net force on said sliding sleeve with said mechanical force acting on said articulated member.

4. The method of claim 3, comprising:

using a peripheral seal as said member.

5. The method of claim 4, comprising:

using a packer cup or inflatable as said articulated member.

6. The method of claim 3, comprising:

retracting said member before repositioning said subterranean tool in said borehole.

7. The method of claim 5, comprising:

moving a sleeve over said packer cup to retract it.

8. The method of claim 1, comprising:

using a plurality of sleeves with discrete profiles as said existing tool;

providing at least one latching key on said subterranean tool that can selectively latch to at least one sleeve.

9. The method of claim 8, comprising:

providing a plurality of latch keys on said subterranean tool configured to engage discrete profiles of different sleeves in the same trip.

10. The method of claim 1, comprising:

using a slickline with a power supply onboard said subterranean tool.

* * * * *